US006719342B2

(12) United States Patent
Shinmoto et al.

(10) Patent No.: US 6,719,342 B2
(45) Date of Patent: Apr. 13, 2004

(54) GRASPING AUXILIARY FOR CARRYING ARTICLE, AND PROCESS FOR PRODUCING THE SAME

(75) Inventors: Mineo Shinmoto, Tokyo (JP); Tadatsugu Sekine, Saitama (JP); Kesashi Suzuki, Tokyo (JP)

(73) Assignee: Tomi Machinery Mfg. Co., Ltd., Tokyo (JP)

( * ) Notice: Subject to any disclaimer, the term of this patent is extended or adjusted under 35 U.S.C. 154(b) by 0 days.

(21) Appl. No.: 10/280,504

(22) Filed: Oct. 25, 2002

(65) Prior Publication Data

US 2003/0102684 A1 Jun. 5, 2003

(30) Foreign Application Priority Data

Oct. 30, 2001 (JP) ..... 2001-332419

(51) Int. Cl.[7] ..... A45F 5/10; B65D 33/06
(52) U.S. Cl. ..... 294/171; 294/137
(58) Field of Search ..... 294/137, 158, 294/171; 16/406, 422, 425; 383/13, 25; D9/434

(56) References Cited

U.S. PATENT DOCUMENTS 2,547,343 A * 4/1951 O'Loughlin ..... 294/171
3,072,955 A * 1/1963 Mitchell ..... 294/171
3,083,366 A * 3/1963 Franges ..... 294/171
3,149,367 A * 9/1964 Dills ..... 294/171
4,890,355 A * 1/1990 Schulten ..... 16/421
4,902,060 A * 2/1990 Nobakht ..... 294/171
5,257,845 A * 11/1993 McConnell ..... 294/171

FOREIGN PATENT DOCUMENTS

DE DT 3509-679 * 9/1986 ..... 294/171
GB 2228860 * 9/1990 ..... 294/171

* cited by examiner

*Primary Examiner*—Dean J. Kramer
(74) *Attorney, Agent, or Firm*—Koda & Androlia

(57) ABSTRACT

A grasping auxiliary for carrying an article or articles includes a tubular body 2. Each of opposite side ends 6*a* and 6*b* of the tubular body 2 with longitudinal notch 3 provided therebetween is formed into a curved-face shape having no corner to facilitate the fitting of a grip portion 5 of an article receptacle such as a film bag into the tubular body 2 and to moderate the pressure contact of the opposite side ends 6*a* and 6*b* with a hand. A plurality of wrinkles are formed on an inner peripheral surface of the tubular body 2 for preventing the sliding movement of the grip portion 5 within the tabular body 2.

6 Claims, 6 Drawing Sheets

GRASPING AUXILIARY FOR CARRYING ARTICLE, AND PROCESS FOR PRODUCING THE SAME

BACKGROUND OF THE INVENTION

1. Field of the Invention

The present invention relates to a grasping auxiliary for carrying an article or articles and a process for producing the same, and particularly, to a grasping auxiliary for carrying an article or articles, which is suitable for protection of fingers from a load applied by the article(s) during carrying of the article(s) using a film bag for accommodating the article (s) purchased in a supermarket store or any of other stores by a purchaser, and a process for producing the same.

2. Description of the Related Art

Conventionally, a film bag for articles of commerce purchased in a supermarket store or any of other stores by a purchaser has been provided from the store.

This film bag is produced in the following manner: A flexible resin material is subjected to a melting/molding treatment using a molding machine called a so-called tubular film-molding machine to produce a long tubular film having folded portions formed at widthwise opposite side edges. Subsequently, a central portion of the tubular film is punched at lengthwise regular distances and then, the remaining portion left after punching of the central portion and a portion which will be a bottom of a previously determined bag are sealed in a widthwise direction by a proper means, and the sealed portion is cut. As a result, the remaining portion left after the punching is a grip portion.

The film bag formed in the above manner is lightweight and has a moderate strength and hence, is extremely convenient for use as a receptacle or container for accommodation of an article or articles.

However, the film bag suffers from the following problem: When the film bag with an article or articles accommodated therein is carried, if the article has a considerable weight, the total weight of the article(s) is applied to fingers grasping the grip portion and hence, the grip portion bites into the fingers. As a result, the fingers are painful and thus, the film bag cannot be grasped for a long time.

To solve such problem, the present inventors have zealous studies and as a result, they have devised a finger-protecting pipe for a film bag described in Japanese Utility Model Application No. 11-007525. According to Japanese Utility Model Application No. 11-007525, the pipe is formed into a U-shape from a flexible foamed resin in an extremely simple structure, so that a grip portion of a film bag is fitted into the pipe for use of the pipe. Thus, the film bag with an article or articles having a considerable weight accommodated therein can be carried safely.

Further pending considerations regarding such a finger-protecting pipe includes a point that the fitting of the grip portion of the film bag into the pipe is further facilitated, leading to an enhanced handleability, and a point that the article(s) can be carried safely and stably.

SUMMARY OF THE INVENTION

Accordingly, it is an object of the present invention to provide a grasping auxiliary for carrying an article or articles, wherein the attachment and detachment of a grip portion of an article-accommodating means such as a film bag to and from the auxiliary can be conducted easily; the swinging movement of the grip portion during carrying of the bag can be limited, and further, the pressure contact of the auxiliary with a hand can be moderated to carry article(s) safely, and it is another object of the present invention to provide a process for producing such a grasping auxiliary.

To achieve the above object, according to a first aspect and feature of the present invention, there is provided a grasping auxiliary for carrying an article or articles, comprising a long tubular body formed from a polymer material into a substantially circular shape or a polygonal shape in section perpendicular to a lengthwise direction with a longitudinal notch provided in part, so that a grip portion of an article receptacle can be fitted into the titular body trough the longitudinal notch, whereby the article receptacle can be carried in a state in which an outer peripheral surface of the tabular body has been grasped, wherein each of opposite side ends of the tubular body with a pair of notches provided therebetween is formed into a curved-face shape having no corner in order to facilitate the fitting of the grip portion into the tubular body and to moderate the pressure contact of the opposite side ends with a hand, and a plurality of wrinkles are formed on an inner peripheral surface of the tubular body in order to prevent the sliding movement of the grip portion within the tubular body.

With such arrangement, each of the opposite side ends of the tubular body with the longitudinal notch provided therebetween is formed into the curved-face shape having no corner. Therefore, it is possible to facilitate the attachment and detachment of the grip portion of the article receptacle to and from the tabular body, and to moderate the pressure contact of the opposite side ends with the hand upon grasping of the tubular body to protect fingers more effectively. In addition, the sliding movement of the grip portion within the tabular body can be prevented and thus, the auxiliary can be used to carry the article(s) stably.

According to a second aspect and feature of the present invention, in addition to the first feature, portions of the tubular body in predetermined regions on the side of the opposite side ends are curved or bent, so that they are recessed inwards in a radial direction of the tubular body.

With such arrangement, particularly, it is possible to further facilitate the fitting of the grip portion into the tubular body and to further effectively moderate the pressure contact of the side ends with the hand upon grasping of the tubular body.

According to a third aspect and feature of the present invention, in addition to the first or second feature, the tubular body and the opposite side ends of the curved-face shape as well as the wrinkles formed on the tubular body are formed in a process for molding a polymer material by folding a long tubular base material flatly with halves integrally superposed on each other, and curving or bending the base material.

With such arrangement, when the base material is folded flatly with the halves superposed on each other, turn-ups are formed at the opposite side ends of the superposed base material, respectively. The opposite side ends of the curved-face shape in the tubular body can be formed easily by virtue of the presence of the turn-ups. One of the halves of the superposed base material on the side of an inner peripheral surface of the tubular body has a circumferential dimensional surplus area formed based on a difference between radius dimensions upon the curving or bending of the base material, as compared with the other half on the side of an outer peripheral surface, and the wrinkles can be formed by producing the looseness or shrinkage in the dimensional surplus area upon curving or bending of the base material.

Further, the base material folded flatly has a double structure, and the tough tubular body can be formed by virtue of the double structure.

According to a fourth aspect and feature of the present invention, in addition to any of the first, second and third features, cutouts are formed at a predetermined depth in the tubular body to extend in a direction crossing the longitudinal notch, so that a grip portion baying a crossing shape can be fitted into the tabular body over an area of crossing of the longitudinal notch and the cutouts.

With such configuration, for example, when a plurality of articles such as books and newspapers are tied together in a crisscross pattern using a long string as an article receptacle, the grip portion of the article receptacle comprising the string assumes the crossing shape, but even when the article receptacle having the grip portion having the crossing shape is used, the grip portion can be fitted into the tabular body by virtue of the presence of the longitudinal notch and the cutouts. Therefore, such an article receptacle can be carried safely and stably. In addition, the grasping auxiliary is suitable for the carrying of an article or articles using any of various types of article receptacles.

According to a fifth aspect and feature of the present invention, the polymer material is a flexable foamed resin.

With such feature, the tubular body can be grasped further stably.

According to a sixth aspect and feature of the present invention, a pair of notches are formed in the lengthwise opposite edge of the tubular body at locations opposed to the longitudinal notch, so that they are recessed in the lengthwise direction of the tubular body.

With such configuration, the sliding movement of the grip portion within the tubular body can be prevented further effectively by fitting the grip portion into the pair of notches.

According to a seventh aspect and feature of the present invention, there is provided a process for producing a grasping auxiliary for carrying an article or articles, comprising a long tabular body formed from a polymer material into a substantially circular shape or a polygonal shape in a section perpendicular to a lengthwise direction with a notch formed in part, so that a grip portion of an article receptacle can be fitted into the tubular body through the notch, whereby the article receptacle can be carried in a state in which an outer peripheral surface of the tubular body has been grasped, the process comprising the steps of folding a long cylindrical base material made of a polymer flatly with halves integrally superposed on each other, and curving or bending the base material to foam a tubular body having a double structure, so that each of opposite side ends of the tabular with the notches provided therebetween is formed into a curved-face shape having no corner to facilitate the fitting of the grip portion into the tubular body and to moderate the pressure contact of the opposite side ends with a hand, and so that a plurality of wrinkles are formed on an inner peripheral surface of the tubular body for preventing the sliding movement of the grip portion within the tubular body.

With such process, when the cylindrical base material is folded flatly, the opposite side ends of the tubular body having the curved-face shape and comprising turn-ups can be formed easily at the opposite side ends of the base material. In addition, the wrinkles can be formed easily by curving or bending the base material, and further, the tough tubular body can be formed by virtue of the double structure of the base material. Thus, it is possible to produce a grasping auxiliary easily and promptly, which can be used to carry the article(s) safely and stably, while protecting fingers effectively. This leads to an enhancement in producing efficiency.

According to an eighth aspect and feature of the present invention, in addition to the seventh feature, notches other than the above-described longitudinal notch are formed at a predetermined depth in the tubular body, so that a grip portion having a crossing shape can be fitted into the tubular body over an area of crossing of the longitudinal notch and the cutouts.

With such configuration, for example, when a plurality of articles such as books are tied together in a crisscross pattern using a long string as an article receptacle, the grip portion of the article receptacle comprising the string assumes the crossing shape, but even when the article receptacle having the grip portion having the crossing shape is used, the grip portion can be fitted into the tubular body by virtue of the presence of the longitudinal notch and the cutouts. Therefore, such an article receptacle can be carried safely and stably. In addition, the grasping auxiliary is suitable for the carrying of an article or articles using any of various types of article receptacles.

The above and other objects, features and advantages of the invention will become apparent from the following description of the preferred embodiment taken in conjunction with the accompanying drawings.

DESCRIPTION OF THE PREFERRED EMBODIMENTS

The present invention will now be described by way of embodiments with reference to the accompanying drawings.

First, a grasping auxiliary for carrying an article or articles according to a first embodiment of the present invention will be described with reference to FIGS. 1 to 3.

Figure 1:
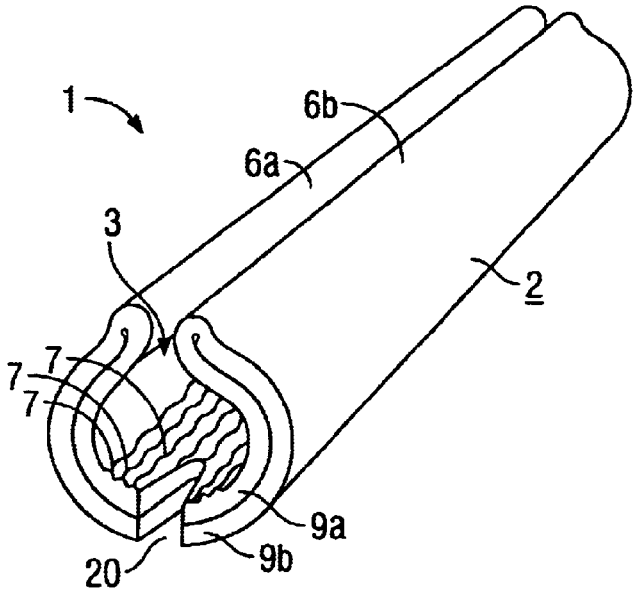
FIG. 1 is a perspective view of a grasping auxiliary for carrying an article or articles according to a first embodiment of the present invention.

Referring to FIG. 1, the grasping auxiliary 1 according to the first embodiment includes a longer tubular body 2 made of, for example, a resin material such as a flexible formed resin, or a polymer material such as a rubber.

Figure 2:
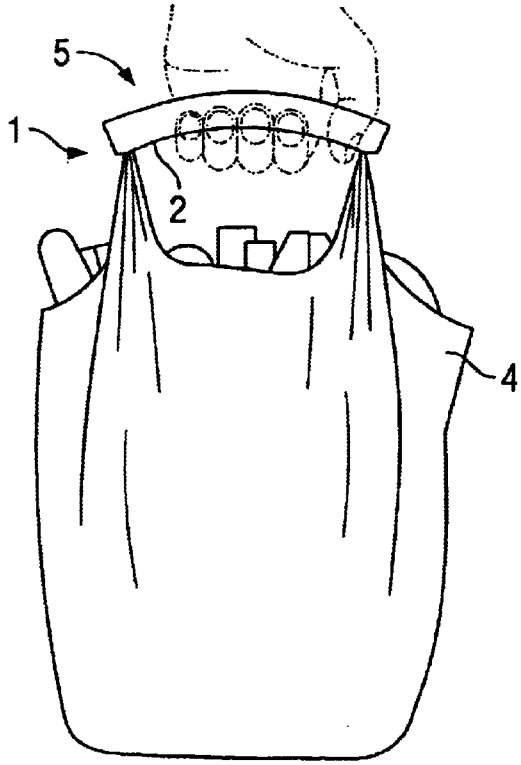
FIG. 2 is a diagram showing the grasping auxiliary in a service state.

As shown in FIG. 2, the tubular body 2 is formed into a substantially circular shape in cut section perpendicular to a lengthwise direction to have longitudinal notch 3 in part so that a grip portion 5 of an article receptacle 4 such as a film bag can be fitted into the tabular body 2 through the longitudinal notch 3. The sectional shape of the tubular body is not limited to the substantially circular shape, and may be a polygonal shape such as a hexagonal shape.

In the present embodiment, each of opposite side ends 6*a* and 6*b* of the tubular body 2 with the longitudinal notch 3 provided therebetween is formed in a curved-face shape having no corner. Therefore, when the grip portion 5 is fitted into the tubular body 2 through the longitudinal notch 3, the grip portion 5 can be prevented from being caught on the opposite side ends 6*a* and 6*b*, of the tubular body 2. Likewise, when the grip portion 5 is removed from the tubular body 2, the grip portion 5 can be prevented from being caught on the opposite side ends 6*a* and 6*b*, of the tubular body 2.

Further, when a person grasps the tubular body 2 with the article receptacle 4 mounted to the tubular body 2, as shown in FIG. 2, the pressure contact of the opposite side ends 6*a* and 6*b* with a person's hand can be moderated.

Therefore, it is possible to smoothly carry out the fitting and separation of the grip portion 5 into and from the tubular body 2 by virtue of the presence of the side ends 6*a* and 6*b* of the tubular body 2, and to prevent fingers from being painful due to the grasping of the tubular body 2 for a long time and in its turn to carry an article or articles safely and stably.

The curvature of the curved-face shape can be changed to any of shapes in accordance with the design concept.

Figure 3:
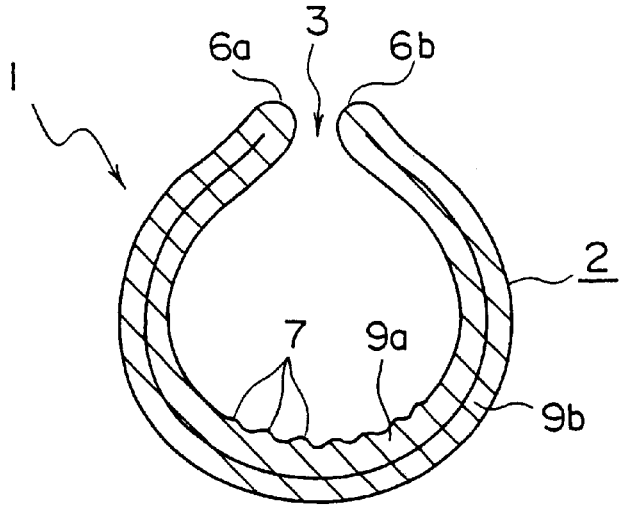
FIG. 3 is a sectional view of the grasping auxiliary shown in FIG. 1.

As shown in FIG. 3, a plurality of wrinkles 7 are formed on an inner peripheral surface of the tubular body 2 in a lengthwise direction of the tubular body 2, so that the grip portion 5 fitted into the tubular body 2 can be prevented by the wrinkles 7 from being slid circumferentially along the inner peripheral surface of the tubular body 2 during carrying of the article receptacle 4.

Therefore, the carrying of the article receptacle 4 can be conducted further stably.

In the present embodiment, a pair of substantially U-shaped notches 20 recessed in the lengthwise direction of the tubular body 2 are further formed in lengthwise opposite edges of the tubular body 2 at locations opposed to the longitudinal notch 3.

Therefore, the grip portion 5 can be fitted into the pair of notches 20 and thus retained and hence, the sliding movement of the grip portion 5 in the tubular body 2 can be prevented more effectively and further, the stable carrying of the article(s) can be realized. The notches 20 may be provided as required.

An embodiment of a process for producing the grasping auxiliary 1 for carrying an article or articles according to the present invention will be described below. In the present embodiment, the production of the article-carrying grasping auxiliary 1 using a flexible foamed resin as a polymer material for convenience will be described, but the present invention is not limited to the use of the flexible foamed resin, and for example, a resin material other than the flexible foamed resin or a polymer material such as a rubber may be used.

Figure 4:
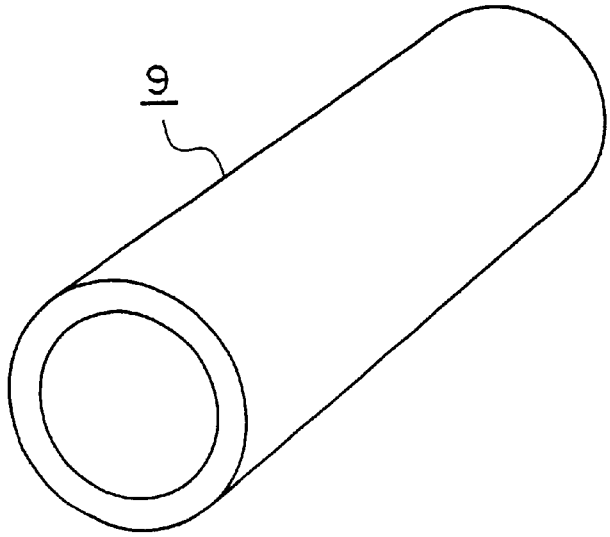
FIG. 4 is a diagram showing a cylindrical base material formed in a process for producing a grasping auxiliary for carrying an article or articles according to the present invention.
Figure 5:
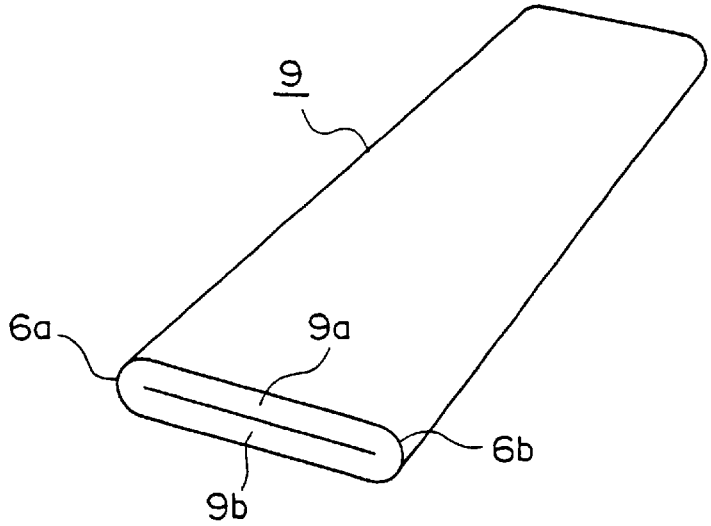
FIG. 5 is a view of a base material having a double structure and formed by folding the cylindrical base material shown in FIG. 3 flatly with halves superposed on each other.

First, as shown in FIG. 4, a long cylindrical base material 9 is formed by the extrusion or inflation of a flexible foamed resin using a common resin-forming die (not shown). Then, the base material is passed between a pair of stable plates, so that it is gradually deformed flatly. Thereafter, the resulting base material is clamped between a pair of rotated pinch rolls and pulled out, whereby the base material is folded flatly with halves superposed on each other, as shown in FIG. 5. Then, superposed opposite wall portions 9*a* and 9*b* of the base material 9 are secured to each other by thermal welding or the like. At this time, turn-ups are formed at widthwise opposite side ends of the base material 9 with the halves superposed on each other, respectively. The turn-ups correspond to the opposite side ends 6*a* and 6*b* of the curved-face shape. Therefore, the opposite side ends 6*a* and 6*b* of the tubular body 2 with the longitudinal notch 3 provided therebetween can be formed into the curved-face shape by a simple process.

Subsequently, the base material 9 with the halves integrally superposed on each other is curved circularly with the opposite side ends moved toward each other. In this case, for example, a substantially cylindrical die may be placed on a transporting line (not shown) for the base material 9 extruded from the die, so that the base material 9 is automatically curved as it is passed through the die along the transporting line.

When the base material 9 is curved, the upper wall portion 9*a* of the base material 9 on the side of the inner peripheral surface of the tubular body 2 has a circumferential dimensional surplus based on a difference between radius dimensions upon the curving of the base material 9, as compared with the lower wall portion 9*b* on the side of the outer peripheral surface, and the wrinkles 7 can be formed by producing the looseness or shrinkage in an area corresponding to the dimensional surplus. Therefore, the opposite side ends 6*a* and 6*b* of the curved-face shape and the wrinkles 7 can be easily formed on the tubular body 2. The base material folded flatly has a double structure comprising the upper and lower wall portions 9*a* and 9*b* shown in FIG. 5 and hence, a tough tubular body 2 can be formed.

Figure 6:
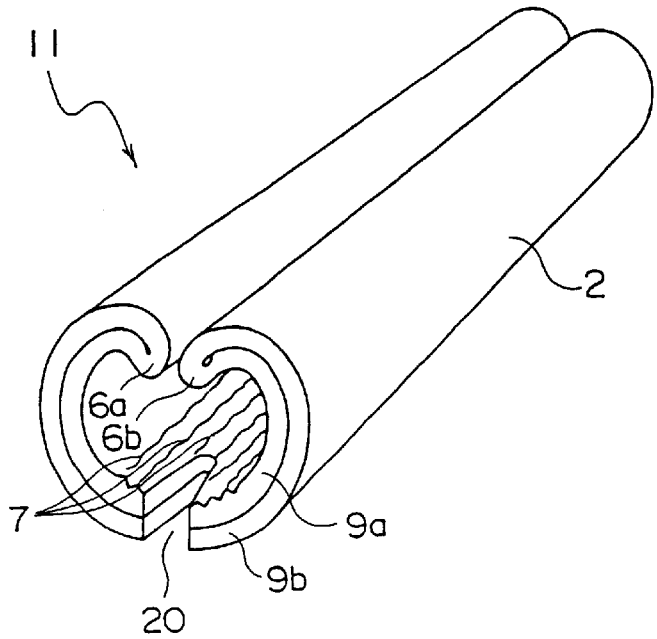
FIG. 6 is a perspective view of a grasping auxiliary for carrying an article or articles according to a second embodiment of the present invention.

A grasping auxiliary for carrying an article or articles according to a second embodiment of the present invention will be described with reference to FIG. 6.

The grasping auxiliary 11 for carrying the article(s) according to the second embodiment is not different in basic arrangement from the first embodiment, except that opposite side ends 6*a* and 6*b* with longitudinal notch 3 provided therebetween are formed in a tubular body 2, so that they are recessed inwards in a radial direction of the tubular body 2.

Therefore, a grip portion 5 of an article receptacle 4 such as a film bag can be fitted more easily into the tubular body 2, than in the auxiliary according to the first embodiment, and it is possible to completely avoid the pressure contact of the opposite side ends 6*a* and 6*b* of the tubular body 2 with the longitudinal notch 3 provided therebetween with a hand upon grasping of the tubular body 2.

Thus, fingers can be protected effectively, and the article receptacle 4 can be carried safely and stably.

A grasping auxiliary for carrying an article or articles according to a third embodiment of the present invention will be described with reference to FIGS. 7 and 8.

Figure 7:
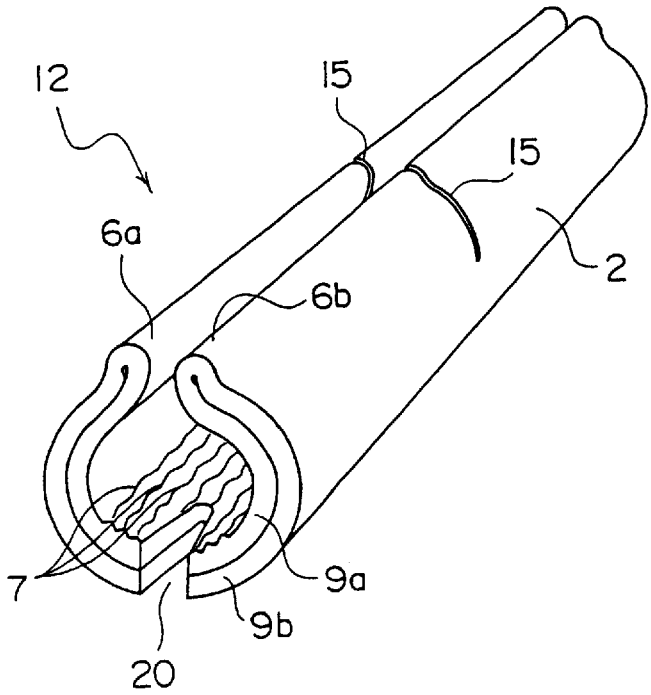
FIG. 7 is a perspective view of a grasping auxiliary for carrying an article or articles according to a third embodiment of the present invention.
Figure 8:
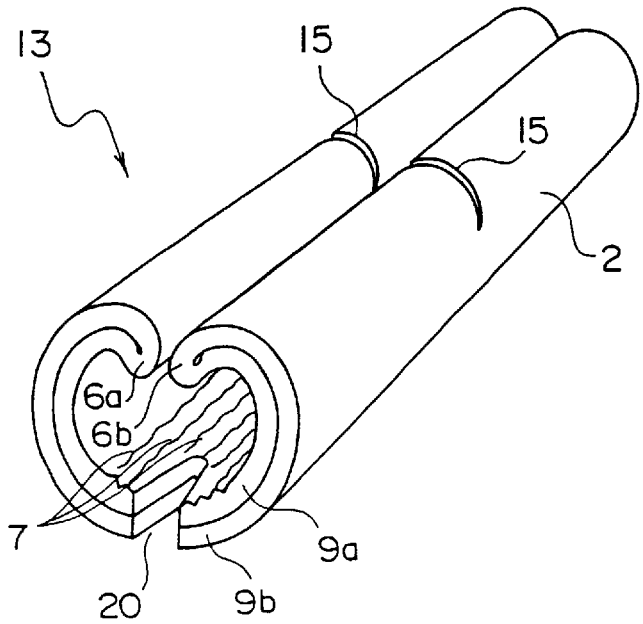
FIG. 8 a perspective view of a grasping auxiliary for carrying an article or articles according to the third embodiment of the present invention, which is in a different form from that in FIG. 6.
Figure 9:
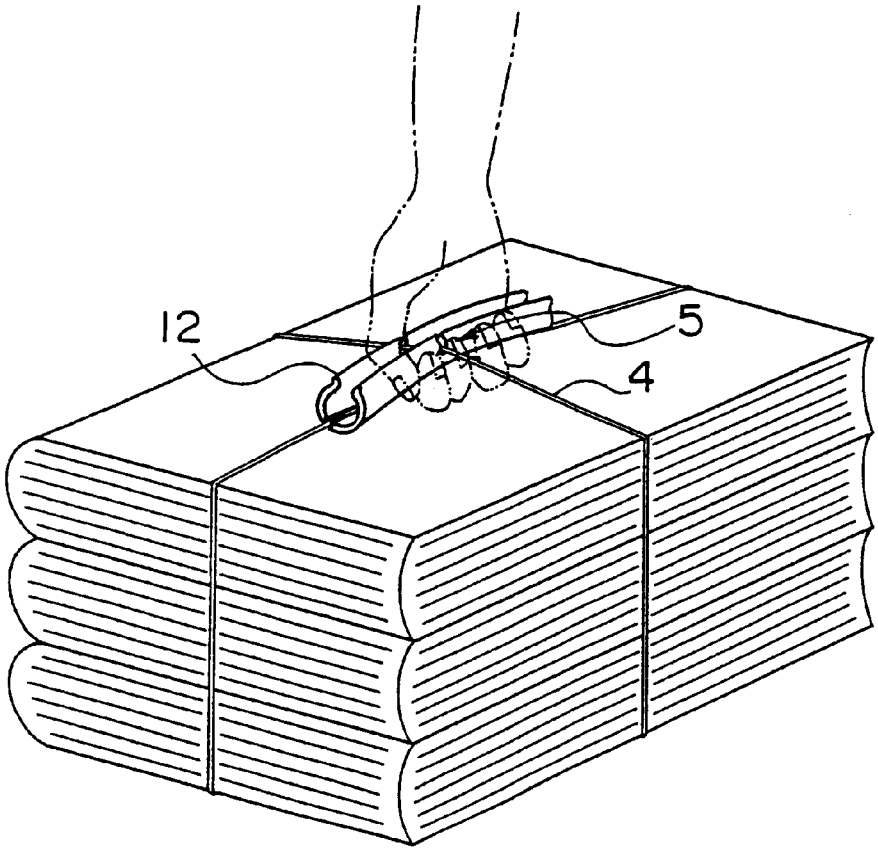
FIG. 9 is a diagram showing the grasping auxiliary according to the third embodiment in a service state.

The grasping auxiliary 12, 13 for carrying the article(s) according to the third embodiment is not different in basic arrangement from the article-carrying grasping auxiliaries 1 and 11 according to the first and second embodiment, except that cutouts 15 are formed at a predetermined depth in a tubular body 2 to extend in a direction crossing longitudinal notch 3, as shown in FIG. 7 or FIG. 8. Therefore, for example, when a plurality of articles such as books are tied together in a crisscross pattern using a long string 16 as the article receptacle 4, as shown in FIG. 9, a grip portion 5 of the article receptacle comprising the string assumes a crossing shape, but even when the article receptacle 4 having the grip portion 5 having the crossing shape is used, the grip portion 5 can be fitted into the tubular body 2 by virtue of the presence of the longitudinal notch 3 and the cutouts 15.

Therefore, the article receptacle 4 having the grip portion of the crossing shape can be carried safely and stably and hence, the grasping auxiliary can be used to carry any of article receptacles 4 of various shapes.

To produce the article-carrying grasping auxiliary 12, 13 according to the third embodiment, after the formation of a tubular body 2 of a grasping auxiliary 1 or 11 as shown in the first and second embodiments, cutouts 15 may be formed at a predetermined depth in the outer peripheral wall of the tubular body 2 provided with longitudinal notch 3 to extend in a direction crossing the longitudinal notch 3. Therefore, the article-carrying grasping auxiliary 12, 13 according to the third embodiment and suitable to carry any of article receptacles 4 of various shapes can be produced easily and promptly.

Although the embodiments of the present invention have been described in detail, it will be understood that the present invention is not limited to the above-described embodiments, and various modifications in design may be made without departing from the spirit and scope of the invention defined in claims.

For example, identifying information for publicity and advertisement such as a trade name may be attached to the outer peripheral surface of the tubular body 2. In such case, a customer using the article-carrying grasping auxiliary necessarily views the identifying information and hence, a good effect for publicity and advertisement can be provided.

Further, the positions of and the number of cutouts 15 formed to intersect the longitudinal notch 3 extending the lengthwise direction of the tubular body 2 may be changed properly in accordance with the form of the grip portion 5 of the article receptacle 4.

Figure 10:
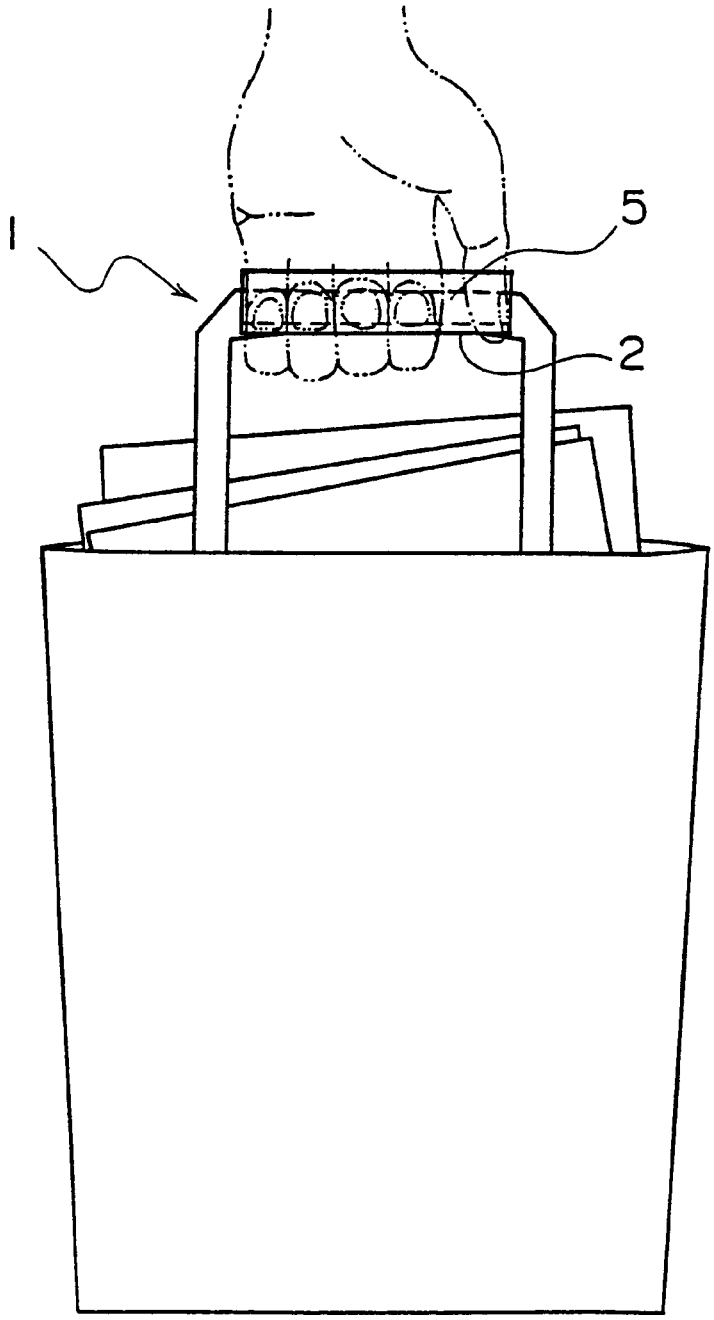
FIG. 10 is a diagram showing the grasping auxiliary in a service state using another article receptacle different from that in FIG. 2.

Furthermore, the article receptacle 4 is not limited to the film bag and the string described above, and for example, may be a paper bag as shown in FIG. 10. Even in this case, the grip portion 5 of the paper bag fitted into the tubular body 2 can be grasped and hence, the paper bag can be carried safely and stably.

What is claimed is:

1. A grasping auxiliary for carrying an article or articles comprising a long tubular body formed from a polymer material into a substantially circular shape or a polygonal shape in section perpendicular to a lengthwise direction with a longitudinal notch provided in part, so that a grip portion of an article receptacle can be fitted into said tubular body through said longitudinal notch, whereby the article receptacle can be carried in a state in which an outer peripheral surface of said tubular body has been grasped, wherein each of opposite side ends of said tubular body with said longitudinal notch provided therebetween is formed into a curved-face shape having no corner in order to facilitate the fitting of the grip portion into said tubular body and to moderate the pressure contact of said opposite side ends with a hand, and a plurality of wrinkles are formed on an inner peripheral surface of said tubular body in order to prevent the sliding movement of the grip portion within said tubular body; and said tubular body and said opposite side ends of the curved-face shape as well as said wrinkles formed on said tubular body are formed in a process for molding a polymer material by folding a long tubular base material flatly with halves integrally superposed on each other, and curving or bending the base material.

2. A grasping auxiliary for carrying an article or articles comprising a long tubular body formed from a polymer material into a substantially circular shape or a polygonal shape in section perpendicular to a lengthwise direction with a longitudinal notch provided in part, so that a grip portion of an article receptacle can be fitted into said tubular body through said longitudinal notch, whereby the article receptacle can be carried in a state in which an outer peripheral surface of said tubular body has been grasped, wherein each of opposite side ends of said tabular body with said longitudinal notch provided therebetween is formed into a curved-face shape having no corner in order to facilitate the fitting of the grip portion into said tubular body and to moderate the pressure contact of said opposite side ends with a hand, and a plurality of wrinkles are formed on an inner peripheral surface of said tubular body in order to prevent the sliding movement of the grip portion within said tubular body;

portions of said tubular body in predetermined regions on the side of the opposite side ends are curved or bent, so that they are recessed inwards in a radial direction of said tubular body; and said tubular body and said opposite side ends of the curved-face shape as well as said wrinkles formed on said tubular body are formed in a process for molding a polymer material by folding a long tubular base material flatly with halves integrally superposed on each other, and curving or bending the base material.

3. A grasping auxiliary for carrying an article or articles according to claim 1 or 2, further including cutouts formed at a predetermined depth in said tubular body to extend in a direction crossing said longitudinal notch, so that a grip portion having a crossing shape can be fitted into said tubular body over an area of crossing of said longitudinal notch and said cutouts.

4. A grasping auxiliary for carrying an article or articles according to claims 1 or 2, further including a pair of notches formed in the lengthwise opposite ends of said tubular body at locations opposed to said longitudinal notch so that they are recessed in the lengthwise direction of said tubular body.

5. A process for producing a grasping auxiliary for carrying an article or articles, comprising a long tubular body formed from a polymer material into a substantially circular shape or a polygonal shape in a section perpendicular to a lengthwise direction with a longitudinal notch formed in part, so that a grip portion of an article receptacle can be fitted into said tabular body through said longitudinal notch, whereby the article receptacle can be carried in a state in which an outer peripheral surface of said tubular body has been grasped, said process comprising the steps of folding a long cylindrical base material made of a polymer flatly with halves integrally superposed on each other, and curving or bending said base material to form a tubular body having a double structure, so that each of opposite side ends of the tubular body with the longitudinal notch provided therebetween is formed into a curved-face shape having no corner to facilitate the fitting of the grip portion into said tubular body and to moderate the pressure contact of said opposite side ends with a hand, and so that a plurality of wrinkles are formed on an inner peripheral surface of said tubular body for preventing the sliding movement of the grip portion within said tubular body.

6. A process for producing a gasping auxiliary for carrying an article or articles according to claim 5, wherein notches other than the above-described longitudinal notch are formed at a predetermined depth in said tubular body, so that a grip portion having a crossing shape can be fitted into said tubular body over an area of crossing of said longitudinal notch and said cutouts.

* * * * *